United States Patent [19]

Steinhilber

[11] Patent Number: 4,883,378

[45] Date of Patent: Nov. 28, 1989

[54] CONTROL SYSTEM FOR SHEET-FEEDING DEVICE FOR PRINTING APPARATUS

[76] Inventor: Helmut Steinhilber, Saline 29, 7210 Rottweil, Fed. Rep. of Germany

[21] Appl. No.: 132,812

[22] Filed: Dec. 1, 1987

Related U.S. Application Data

[62] Division of Ser. No. 846,779, Mar. 26, 1986.

[30] Foreign Application Priority Data

Apr. 4, 1985 [DE] Fed. Rep. of Germany ..... 3512419

[51] Int. Cl.[4] ..... B41J 11/58; B41J 13/10

[52] U.S. Cl. ..... 400/624; 400/629; 400/649; 400/605; 271/9

[58] Field of Search ..... 400/605, 607, 609, 608.1, 400/608.2, 707.5, 624, 629, 649; 271/9, 152, 167, 168

[56] References Cited

U.S. PATENT DOCUMENTS

| | | | |
|---|---|---|---|
| 4,248,415 | 2/1981 | Steinhilber | 400/624 X |
| 4,277,059 | 7/1981 | Dunning | 400/624 X |
| 4,570,919 | 2/1986 | Huang | 400/624 X |
| 4,664,546 | 5/1987 | Runzi | 400/624 |
| 4,729,680 | 3/1988 | Osterlund et al. | 400/624 |

FOREIGN PATENT DOCUMENTS

| | | | |
|---|---|---|---|
| 102384 | 6/1982 | Japan | 400/624 |
| 42079 | 3/1985 | Japan | 400/624 |
| 56580 | 4/1985 | Japan | 400/624 |

*Primary Examiner*—David A. Wiecking
*Assistant Examiner*—James R. McDaniel
*Attorney, Agent, or Firm*—Thomas P. Mahoney

[57] ABSTRACT

A sheet-feeding device for feeding individual sheets to the platen of a printing apparatus from a single storage unit or a plurality of storage units is provided. The sheet-feeding device incorporates selecting discs incorporating a switching arrangement for the purpose of establishing a driving connection with the associated printing apparatus to a separating roller for withdrawing a sheet from the selected storage unit. In the storage units which have not been selected, the switching disc prevents inadvertent activation of the non-selected storage units by a blocking device controlled by a counter which permits the switching arrangement to be blocked during the printing process in order to prevent undesired sheet feeding.

5 Claims, 5 Drawing Sheets

CONTROL SYSTEM FOR SHEET-FEEDING DEVICE FOR PRINTING APPARATUS

This is a division of application Ser. No. 846,779 filed Mar. 26, 1986, which has been allowed.

BACKGROUND OF THE INVENTION

This invention relates to a control system for a device for feeding individual sheets to the platen of a printing apparatus.

Devices are presently utilized in which stacks of sheets are stored in one or more storage units, said devices being associated with various types of printing apparatus. Separating means is provided for each storage unit which is driven by the platen of the printing apparatus through various means such as gears, or the like.

Selecting means is interposed in the drive train between the platen of the printing apparatus and the separating means so that a selecting means is provided for each separating means.

The separating means can be provided in the form of a separating roller or equivalent structure and is designed to strip the uppermost sheet of the stacked sheets in a selected storage unit from said stack.

The selecting means determines that only one selected separating means is actuated at a given time and that a sheet is fed to the platen of the printing apparatus from the selected storage unit. The selecting means are controlled mechanically by the platen through the gear train or other drive in that the platen is controlled by a sequence of forward and backward rotary movements which are, in turn, designed to control each selecting means. Consequently, the activation of the separating means, as well as the selection of the respective storage unit, is accomplished by the programcontrolled rotation of the platen of the printing apparatus.

In the sheet-feeding device disclosed in U.S. Pat. No. 4,248,415 the selecting means consists of a pawl which is mounted on a pawl disc, whereby the pawl engages a selecting disc which drives the separating means by means of an overrunning clutch drive. A control lever pivotally mounted upon the selecting disc releases the pawl from the selecting disc when the associated storage units are not involved in the sheetfeeding process.

In another embodiment of the device disclosed in the '415 patent, the selecting disc is provided with a switching arrangement in the form of a selecting channel extending through the selecting disc and the selecting channel is obstructed at one of its extremities by a leaf-type spring functioning as a switching member. When activating a selected storage unit, the pawl, as the result of the predetermined sequence of forward and backward rotary movements of the platen of the printing apparatus, engages the selecting channel and drives the selecting disc, the selecting disc then driving the separating means constituted by a separating roller through the previously mentioned overrunning clutch.

The pawls of the unactivated storage units pass through the selecting channel in one direction of rotation and emerge from said channel by deflection of the leaf-type spring or are carried away in the opposite direction of rotation over the selecting channel through the operation of the leaf-type spring. In the known devices discussed hereinabove, the selecting means is costly as it requires an overrunning clutch or an overriding freewheel drive.

When the prior art devices disclosed hereinabove are utilized with printing apparatus which imprints the sheet on the platen with mathematical or chemical formulae or with graphical representations, the platen is frequently rotated forward and backward by a few or several line increments and the characteristic control sequence of the forward and backward rotary increments of the platen intended to activate the selecting mechanism or means of an associated storage unit can manifest itself accidentally with the result that the selecting means is accidentally activated unintentionally.

Disclosed in co-pending application Ser. No. 781,792 is a construction wherein the pawl on the driven pawl disc, while being controlled by a selecting disc, engages a toothed disc to establish the driving connection between the platen of the printing apparatus and the selected separating means or roller. In order to prevent the inadvertent operation of the separating means or roller during the imprinting of formulae or graphic representations, the selecting means or devices are locked by a locking device during the printing process and a single revolution coupling driven by the platen of the printing apparatus inactivates the locking device at the end of the printing of the formulae or graphic representations so that the next selecting process can take place.

OBJECTS AND ADVANTAGES OF THE INVENTION

A primary object of the invention is a control system or device for a sheet feeder of the previously discussed character which prevents the undesired and inadvertent feeding of sheets to the platen of the associated printing apparatus while formulae or graphic representations are being imprinted upon a sheet already located upon the platen of the printing apparatus.

Another object of the invention is the provision of a selecting means or device interposed between the platen of the printing apparatus and the separating means which includes a pawl engagement with a toothed disc. A selecting disc provided with a switching arrangement retains the pawl out of engagement with the toothed disc to interrupt the driving connection with the corresponding separating means or roller.

In order to feed a sheet from a selected storage unit, when dealing with a sheet-feeding device incorporating several storage units, or in order to feed a sheet from a single storage unit, when dealing with a device incorporating only such a single storage unit, the pawl disc is initially rotated by the platen from its initial position by a specific number of rotary incremental movements. Thus, depending on the number of movements, the pawl of the corresponding selection means arrives in the switching means, that is, in the selecting channel extending through the selecting disc, and engages the corresponding toothed disc. during subsequent rotation of the platen in the opposite direction, the separating means or roller of the selected storage unit is driven by the intervention of the pawl engaged upon the toothed disc, in order to feed a sheet from the selected storage unit to the platen of the printing apparatus.

The selecting means of the inoperative storage units are not actuated because the pawls have not as yet engaged the switching means or have bypassed the switching means during the initial rotation of the platen, with the result that, upon rotation of the pawl discs in the sheet-feeding direction, the switching means does not permit engagement of the pawl with the toothed disc.

The above-described selecting means is equally suited for cases in which the platen and the separating means are driven in the same or opposite directions by the platen.

Another object of the invention is a device of the aforementioned character which can be utilized for a sheet-feeding device which incorporates only a single storage unit, although in the case of a single storage unit a selection process need not be followed. With the control of the invention, it is possible to establish the driving connection between the platen of the printing apparatus and the separating means or roller of the single storage unit at a desired point in time. Therefore, the individual sheets are not automatically fed one after the other to the platen of the printing apparatus, but can be fed from the storage unit in a desired sequence.

Because the selecting means of the invention permits the driving connection to be established only for the selected storage unit, an overriding free-running drive or overrunning clutch is not necessary.

the elimination of the overrunning clutch or overriding free-running drive and the provision of selecting means which is activated by a single selecting disc greatly reduces the complexity of the selecting means from a component point of view with resulting economies in manufacture.

therefore, the selecting means of the invention permits any desired forward and backward rotation of the platen of the printing apparatus during the printing process without running the risk that the selecting device of an inactive storage unit can be accidentally activated with the undesirable result of feeding an additional sheet while a sheet is still being imprinted upon the platen of the printing apparatus.

To prevent such inadvertent operation of an inactive selecting means, locking means and a counting or measuring device are provided which locking means can be switched between positions blocking and freeing the switching arrangement. The counting or measuring device counts or measures the rotary incremental movements of the platen and, after the ascertainment of a number of line spacings corresponding to the complete sheetfeeding cycle and printing cycle, switches the locking device to free the selecting means of the various storage units for the next selecting process.

BRIEF DESCRIPTION OF THE DRAWINGS:

Other objects and advantages of the invention will be apparent from the following specification and the accompanying drawings, which are for the purpose of illustration only, in which.

DESCRIPTION OF PREFERRED EMBODIMENTS OF THE INVENTION

The sheet-feeding device is mounted on the top of the associated printing apparatus which, for example, serves as the output printing apparatus for an electronic recording system, an electronic data processing installation, or the like.

Figure 1:
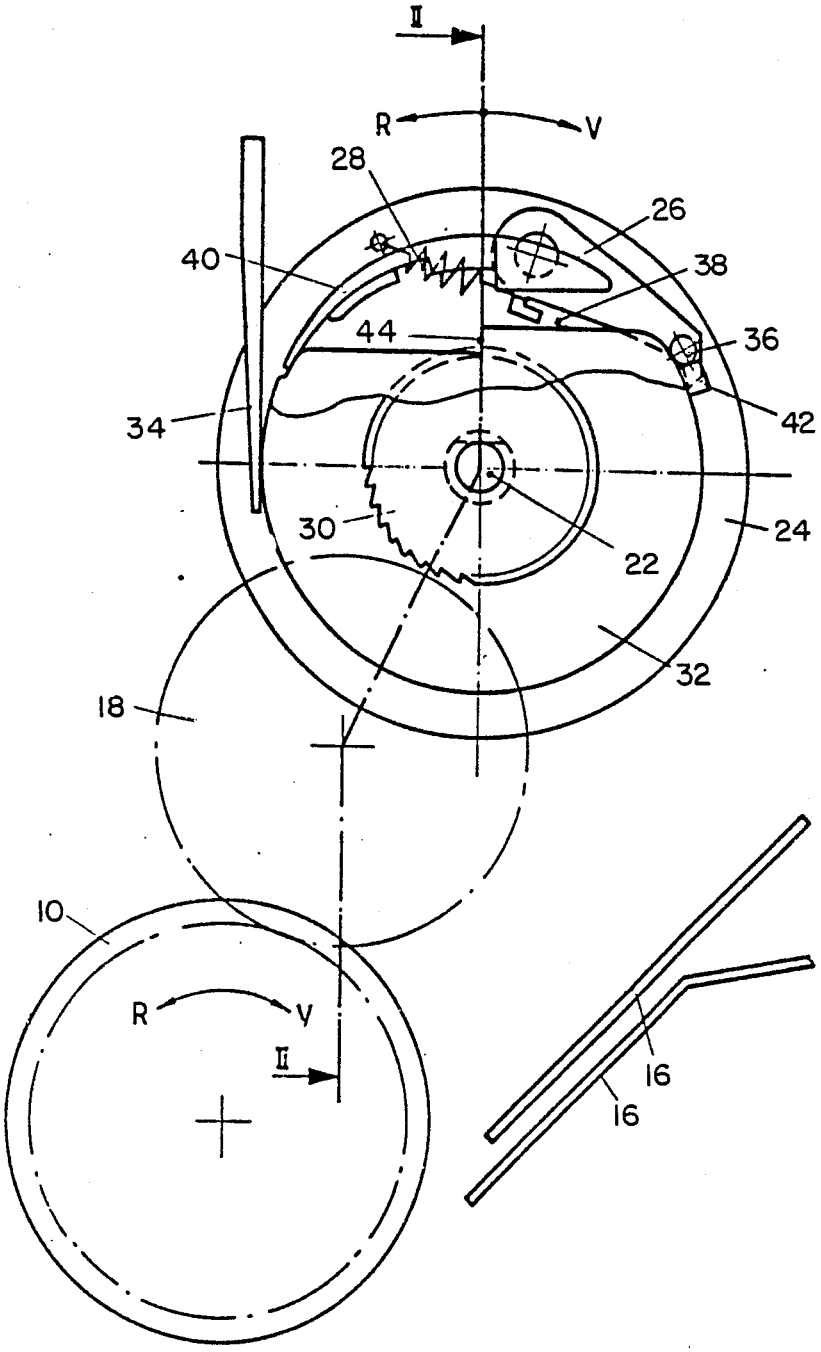
FIG. 1 is a side elevational view of a first embodiment of the invention.
Figure 2:
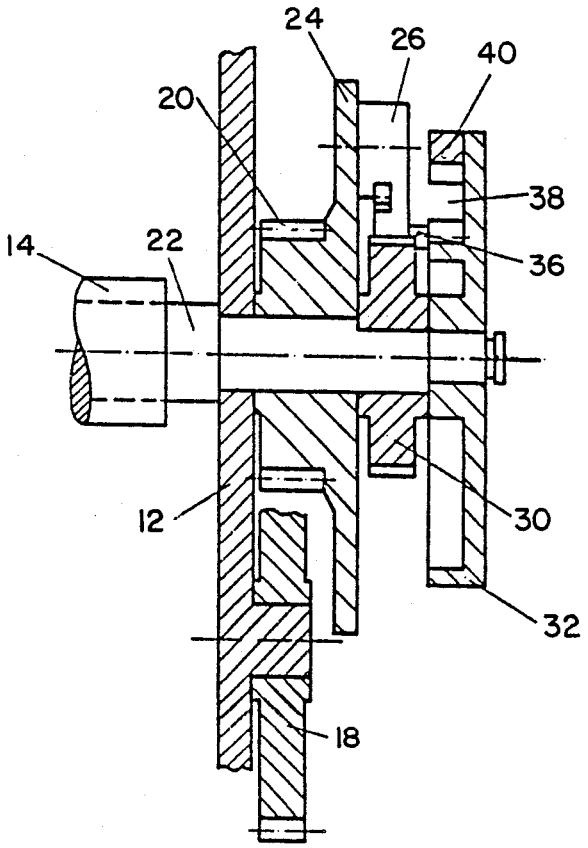
FIG. 2 is a cross sectional view taken from the line II—II of FIG. 1.

Since the printing apparatus is known to those skilled in the art, all that is shown of the printing apparatus in the drawings is the gear 10, FIG. 1, which is connected for rotation by the shaft of the printing apparatus.

the sheet-feeding device is incorporated in a housing having sidewalls 12, FIG. 2, only one of which is shown, said housing containing one or more storage units for stacks of individual sheets to be fed to the platen of the associated printing apparatus. Each storage unit, not shown, has separating means constituted by a separating roller 14, FIG. 2, associated therewith. The separating rollers are rotatably mounted in the sidewalls 12 and frictionally engage the uppermost sheet in a stack stored in the associated storage unit. The separating roller 14 urges the uppermost sheet out of the associated storage unit and, via guide plates 16, FIG. 1, feeds the sheet to the platen of the printing apparatus.

The separating rollers 14 are driven by intermediary gears 18 which, in turn, are driven by the gear 10 connected with the platen. When the sheet-feeding device incorporates several storage units and, consequently, several separating rollers 14, all of the separating rollers are driven in the same manner and, consequently, only one separating roller 14 is illustrated in FIG. 2 of the drawings.

In the embodiments of FIGS. 1–6, an off number of intermediary gears 18 is provided so that the platen and the separating roller 14 are driven in the same direction. When the platen is driven in the forward direction V, FIG. 1, that is to say in the direction in which the sheet is drawn onto the platen, the separating roller 14 is driven in the sheet-feeding direction in which it urges a sheet out of the associated storage unit and feeds it to the platen.

In the exemplary embodiment of FIGS. 1 and 2, the platen, by means of the intermediary gear or gears 18 drives a gear 20, FIG. 2 which is mounted for relative rotation on the shaft 22 of the associated separating roller 14. The gear 20 is integrally formed with a pawl disc 24 which mounts a pawl 26 near its periphery and which is pulled against a toothed disc 30, FIGS. 1–2, by means of a tension spring 28.

The toothed disc 30 is fixedly mounted on the shaft 22 of the separating roller 14 and a selecting disc 32, FIGS. 1–2, is located adjacent the toothed disc 30 and is freely rotatable on the shaft 22. Rotary movement of the selecting disc 32 is decelerated by braking means 34 constituted, for example, by means of a leaf-spring engageable with the periphery of the disc 32.

The pawl 26 is mounted on a pin 36, FIGS. 1–2, which projects axially and permits the pawl 26 to traverse the periphery of the selecting disc 32, said pawl being biased against said periphery by the tension spring 28. The diameter of the selecting disc 32 prevents the pawl 26 from engaging the toothed disc 30 when the pawl pin 36 lies at the outer periphery of the selecting disc 32.

Incorporated in the selecting disc 32 is a selecting channel 38, FIGS. 1–2, which extends through the selecting disc 32 in secant form and at its opposite extremities extend into the outer periphery of the selecting disc 32. A leaf-type spring 40 obstructs one extremity of the selecting channel 38. The pawl pin 36 can exit the selecting channel 38 by bending the leaf spring 40 away from the associated extremity of said channel. However, entry of the pawl pin 36 into the blocked extremity of the selecting channel 38 is prevented by the spring 40.

when the pawl pin 36 is located in the selecting channel 38, the pawl 26 engages the toothed disc 30 and establishes the driving connection between the platen and the separating means or roller 14 to drive the separating roller in the direction V when the platen rotates in said direction. During rotation of the pawl pin 36 in the direction V, it abuts against an entrainment abutment 44 of the selecting channel 38 so that, in opposition to the action of the braking element 34, the selecting disc is carried along by the pawl 26.

A stop 42 for the pawl pin 36 is located a predetermined angular distance with respect to the entrainment abutment 44 of the selecting channel 38. When the sheet-feeding device incorporates several storage units, the selecting devices or means differ from one another only by the given or predetermined angular distance between the selecting channel 38 and the stop 42.

In order to feed a sheet from a selected storage unit to the platen by the utilization of the device shown in FIGS. 1–2 of the drawings, the selecting or control system initiates its operation from the starting position shown in FIG. 1 in which the pawl 26 lies against the stop 42.

In order to activate the selected storage unit, the platen, program-controlled by the printing apparatus, is rotated backward by a given number of line spacings in the direction R, which is the opposite direction to the direction in which a sheet is drawn onto the platen. Consequently, the pawl discs 24 of all of the storage units, together with their pawls 26, are driven in the direction R relative to the selecting discs 32 which are tightly restrained by the braking means 34.

Rotating the pawl disc 24 in the direction R by the predetermined number of line spacings causes the pawl pin 36 of the selected storage unit to enter the selecting channel 38 and the pawl 26 of the selected storage unit engages with the toothed disc 30.

Because the angular distance between the stop 42 and the entrainment abutment 44 of the selecting channel 38 differs for each storage unit, the pawl pins 36 of non-selected storage units either do not enter the selecting channel 38 or pass through the selecting channel 38 and leave the extremity of said channel by deflecting the leaf spring 40.

For example, if three storage units are incorporated in the sheet-feeding device, the angular distance between the stop 42 and the entrainment abutment 44 of the selecting channel 38 can amount to four line spacings for the first storage unit, eight line spacings for the second storage unit and twelve line spacings for the third storage unit. If the second storage unit is the selected one, the platen is rotated in the direction R by eight line spacings from the original starting position of FIG. 1.

So far as the first storage unit is concerned, the pawl pin 36 has entered the selecting channel 38 after four line spacings and, after the completion of eight line spacings, has left the selecting channel 38 by deflection of the leaf spring 40.

So far as the second storage unit is concerned, after eight line spacings have occurred, the pawl pin 36 lies against the entrainment abutment 44 of the selecting channel 38. In the case of the third storage unit, the pawl pin 36 has not as yet reached the selecting channel 38 after eight line spacings.

Subsequently, again program-controlled by the printing apparatus, the platen is rotated in the forward direction V and, in the case of the selected storage unit, in which the pawl 26 engages the toothed disc 30, the separating roller 14 is driven in the forward direction V and urges the uppermost sheet of the stacked sheets in the storage unit toward the platen. Because the pawl pin 36 lies against the entrainment abutment 44 of the selecting channel 38, the pawl pin 36 during the rotation in the direction V carries the selecting disc 32 along with it in opposition to the braking action of the braking means 34.

In the case of the storage units which have not been selected, when the pawl disc 24 is rotated in the direction V, the pawl pin 36 traverses the periphery of the selecting disc 32 and engages the stop 42 because the pawl pin 36 has either not yet reached the selecting channel 38 or is prevented from entering the selecting channel 38 by the leaf-type spring 40. Therefore, the pawl 26 is not permitted to engage the toothed disc 30 and the separating means or rollers 14 of the non-selected storage units are not actuated.

When, during the rotation of the platen of the printing apparatus in the direction V, a sheet has been urged from the selected storage unit so that its leading edge is engaged by the platen, the platen is initially rotated in the feeding direction V, in order to fully draw the sheet onto the platen. Subsequently, the platen, being program-controlled, is rotated backwardly in the direction R by such a number of line spacings or rotary increments that, in the case of all of the storage units, the pawl pins 36, starting at the stop 42 of the selecting disc 32, pass through the selecting channel 38 and emerge from said channel by outwardly displacing the leaf-type spring 40. Thus, in the case of the selected storage unit, the pawl 26 is disengaged from the toothed disc 30.

By the reverse or backward rotation of the platen, the sheet on the platen is positioned at the first line to be imprinted. During reverse rotation of the platen, the separating means or rollers 14 are inoperative and the imprinting of the sheet on the platen can be initiated.

The platen is again rotated in the sheet-feeding direction V and, in the course of the imprinting process, the pawls 26 on the pawl discs 24 associated with each of the storage units again have their pins 36 abutting the stop 42. Therefore, engagement of the pawls 26 with the respective toothed discs 30 is prevented so that the separating means or rollers 14 of the respective storage units are not actuated.

Therefore, the sheet-feeding device has its various components located in the normal starting position illustrated in FIG. 1 so that the storage unit selecting cycle and the sheet-feeding cycle can be reinitiated when the sheet upon the platen has been completely imprinted and ejected by the platen.

when the platen of the embodiment of FIGS. 1 and 2 is reversely rotated by a few line spacings during the printing process, as is the case, for example, during the printing of mathematical or chemical formulae or the plotting of curves, an accidental sequence of backward and forward line spacings or rotary steps can occur, which causes the pawl 26 of a storage unit to engage its respective toothed disc 30 which would result in a sheet being fed to the platen from the corresponding storage unit while the platen has a previously fed sheet entrained thereupon.

SECOND EMBODIMENT OF THE INVENTION

By the utilization of the second embodiment of the invention illustrated illustrated in FIGS. 3–7 of the drawings, the possibility of accidental actuation of the selecting means of an inoperative storage unit while a sheet is entrained upon the platen of the printing apparatus is obviated. To the extent that the embodiment of FIGS. 3–7 is structurally identical with the embodiment of FIGS. 1 and 2, the same reference numerals are utilized in references made to the preceding description of the previously discussed embodiment.

In addition to the components incorporated in the embodiment of FIGS. 1–2, the embodiment of FIGS. 3–7 includes a selecting channel locking means or device adjacent the inlet opening at the extremity opposite that closed by the utilization of the leaf-type spring 40.

Figure 4:
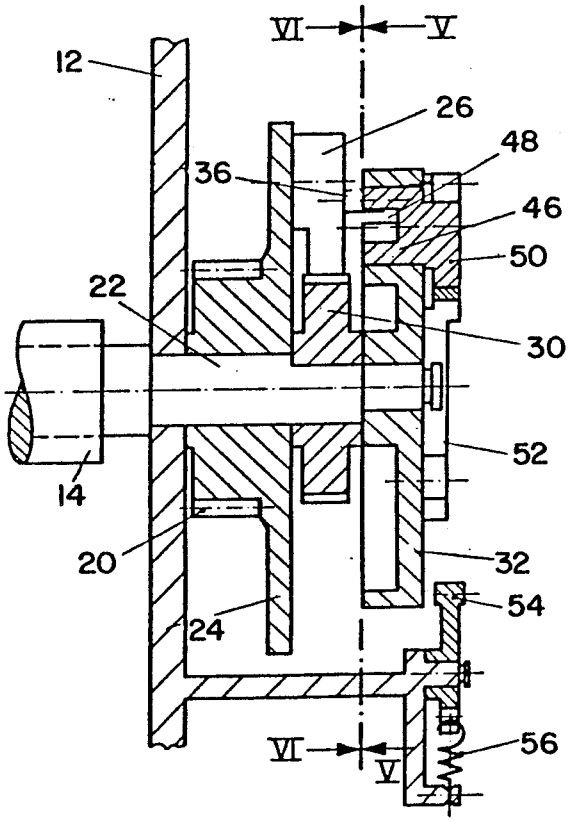
FIG. 4 is a cross sectional view taken along the line IV—IV of FIG. 3.
Figure 6:
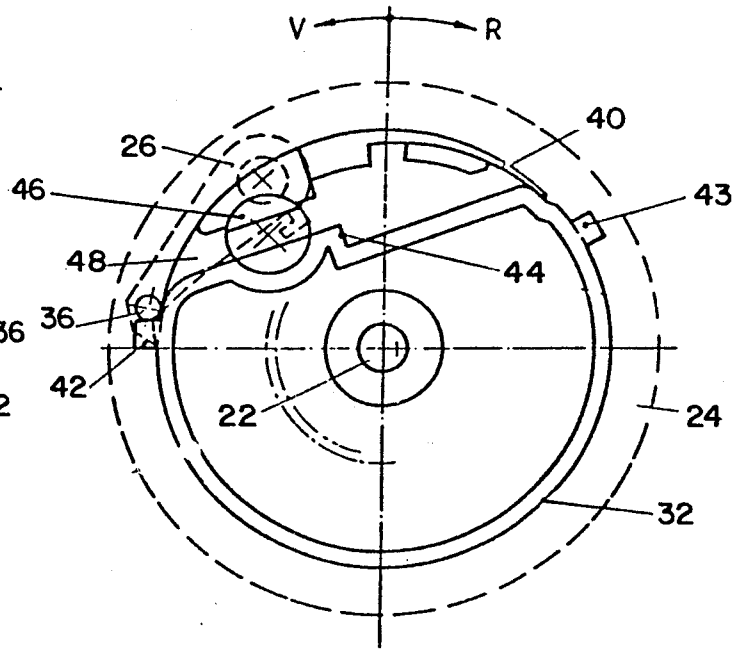
FIG. 6 is a sectional view taken on the broken line VI—VI of FIG. 4.
Figure 5:
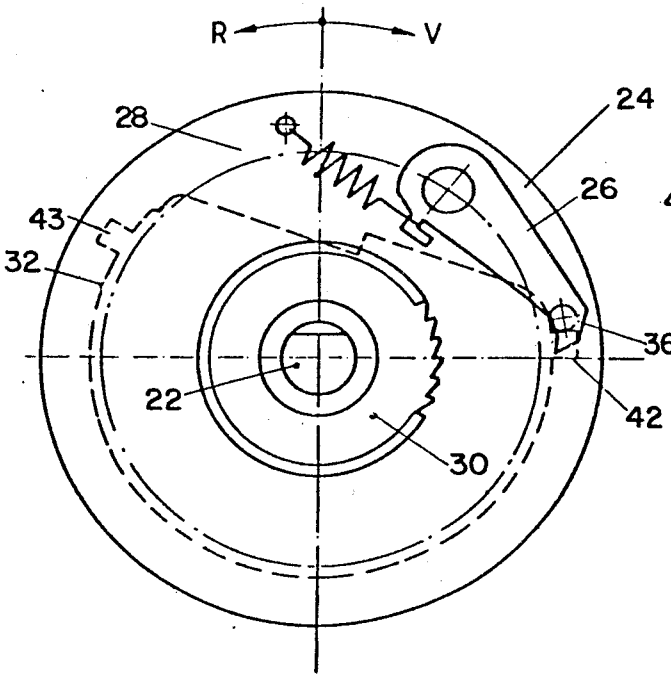
FIG. 5 is a cross sectional view taken on the broken line V—V of FIG. 4.
Figure 8:
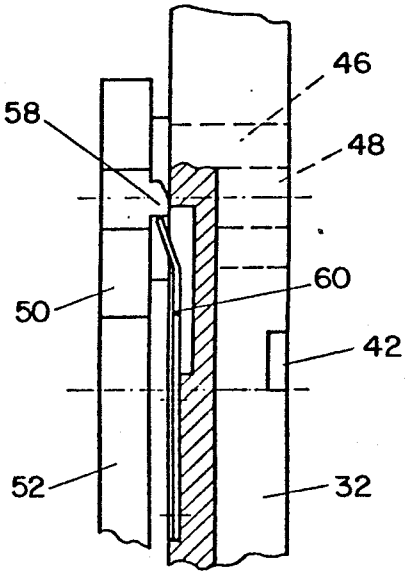
FIG. 8 is an enlarged, fragmentary cross sectional view taken on the broken line VIII—VIII of FIG. 7.

The channel locking means or device includes a cylindrical body 46 having a diametrical channel 48, as best shown in FIGS. 4–6 of the drawings. The body 46 is inserted in the selecting disc 32, as best shown in FIGS. 4 and 6 of the drawings, so that it can be rotated about its axis which extends through the selecting channel 38 perpendicularly to the plane of the selecting disc 32. When the diametrical channel 48 of the body 46 is aligned with the selecting channel 38, as best shown in FIG. 6 of the drawings, the pawl pin 36 can enter the selecting channel 38 through the diametrical channel 48. In all other rotary positions of the cylindrical body 46 it blocks the inlet opening to the selecting channel 38.

Figure 3:
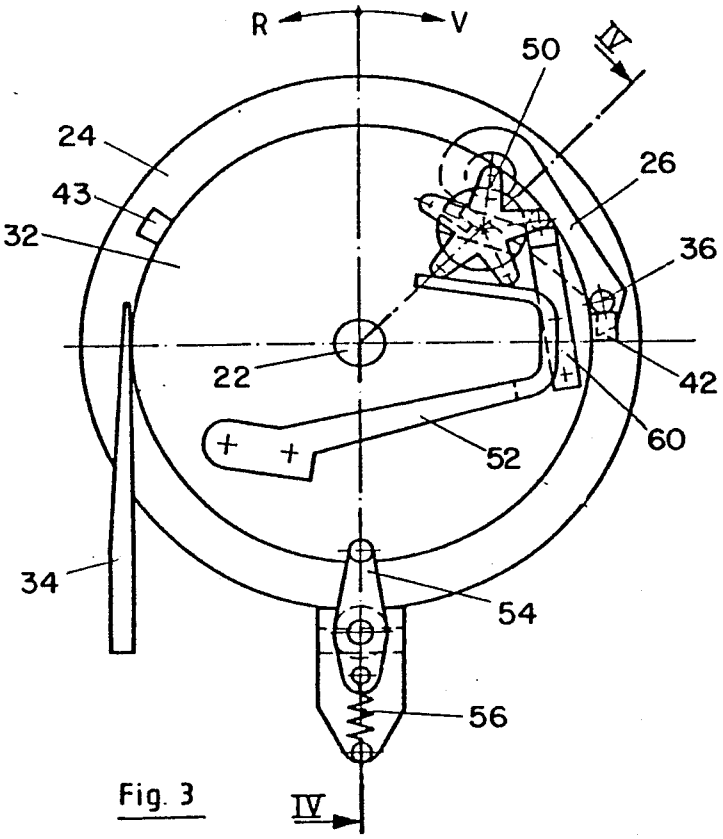
FIG. 3 is a side elevational view of an additional embodiment of the invention.

Integrally formed upon the cylindrical body 46 is a counting means or wheel 50 which, in the present embodiment of the invention, is in the form of a five-pointed star. The counting wheel 50 is located on the outer axial frontal surface of the selecting disc 32. Also located at the outer axial frontal surface of the selecting disc 32 is a leaf spring 52 which is affixed to said disc 32 and has a free flexible extremity lying against the counting wheel 50. Therefore, the counting wheel 50 is maintained in the angular positions in which two points of the counting wheel rest on the leaf spring 52, as best shown in FIG. 3 of the drawings. The counting wheel 50 can, therefore, be switched from one position to the other positions in a step-by-step manner, so that in a complete rotation it is located in five different angular positions. The step-by-step rotation of the counting wheel 50 is accomplished during the rotation of the selecting disc 32 by means of a switching cam 54 which is mounted adjacent the rotational path of the counting wheel 50 and is maintained in a position where it can engage the counting wheel 50 by a tension spring 56, as best shown in FIG. 3 of the drawings.

When the selecting disc 32 is rotated, the counting wheel is carried past the switching cam 54, which engages with one of the points of the counting wheel 50 and, depending on the direction of the rotation of the selecting disc 32, rotates the counting wheel by one step in one or the other direction of rotation. When, in a manner to be described hereinbelow, the counting wheel 50 is prevented from rotating, the switching cam 54 can be deflected against the bias of the spring 56 so that the counting wheel remains in the previously established position.

Figure 7:
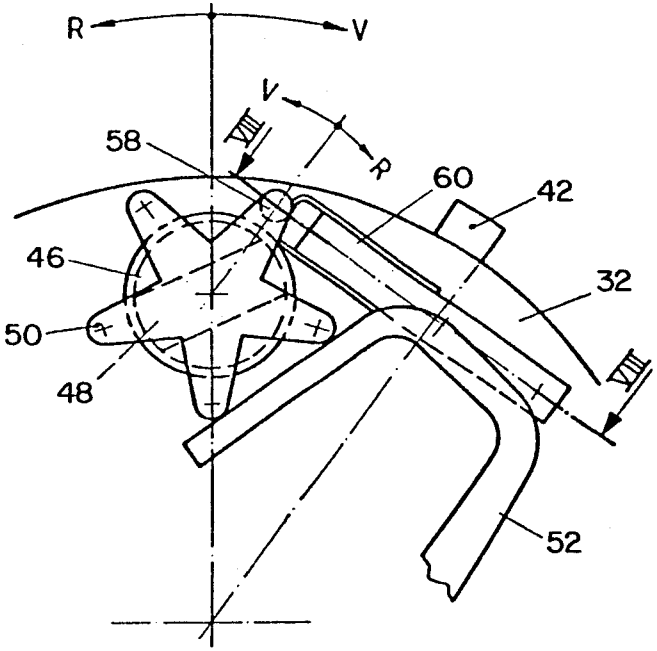
FIG. 7 is an enlarged, cross sectional, partly fragmentary view of the counting or measuring wheel or device.

The counting wheel 50, as best shown in FIGS. 4 and 7, incorporates a projecting cam 58 on its bottom side adjacent the selecting disc 32. An inclined leaf spring 60, FIGS. 3 and 7, which is juxtaposed to the cylindrical body 46, together with the diametrical channel 48 serves to obstruct the selecting channel 38. The leaf spring 60 is mounted with one of its extremities at the surface of the selecting disc 32 facing the counting wheel 50 and extending upwardly from said surface toward the counting wheel 50. The leaf spring 60 permits the counting wheel 50 to rotate in one direction, in FIG. 7, a counterclockwise direction, since the leaf spring 60 is deflected by the cam 58. However, in the clockwise direction, the am 58, in the position shown in FIG. 7, abuts the leaf spring 60 when the diametrical channel 48 of the cylindrical body 46 is aligned with the passage constituted by the selecting channel 38.

Limiting the rotary movement of the pawl disc 24 with respect to the selecting disc 32 is an additional stop 43, FIG. 3, which is located on the selecting disc 32 to the rear of the outlet extremity of the selecting disc 38.

THE OPERATION OF THE ALTERNATIVE EMBODIMENT OF THE INVENTION

The alternative embodiment of the invention, shown in FIGS. 3–7, in order to locate the elements of the sheet-feeding device in the basic position to accomplish the selecting process, has the platen of the associated printer rotated, in a program-controlled manner, in the direction R, FIG. 3, in opposite direction to the sheet-feeding direction by a predetermined number of line spacings so that the pawl discs 24 of the storage units accomplish at least five rotations in the direction R. The pawls 26, through the operation of the pawl pins 36, either engage the closed selecting channel 38 or the stop 43 and rotate the selecting discs 32 in the direction R.

thus, the counting wheel 50 is rotated five times to engage the switching cam 54. It causes the counting wheel 50 to be further rotated by one toothed element in a clockwise direction.

Independently of the position in which the counting wheel 50 is located at the beginning of the rotation of the selecting disc 32, the cam 58 engages the leaf spring 60 so that the diametrical channel 48 of the cylindrical body 46 is aligned with the selecting channel 38. In this position, the counting wheel 50 is tightly maintained and, upon eventual further rotation of the selecting disc 32, urges the switching cam 54 away in opposition to the bias of the spring 56.

Subsequently, the platen and the pawl disc 24 are rotated in the forward direction V for all of the storage units so that the pawl 26 and pawl pin 36 move away from the stop 43 on the selecting disc 32 to the stop 42 of said selecting disc. Therefore, the selecting disc 32 is not rotated since the leaf spring 40 prevents the pawl pin 36 from entering the selecting channel 38 and the braking means or element 34 securely retains the selecting disc 32 against rotation. The sheet-feeding device is now located in the starting position for the selected process in which, in the case of each storage unit, the associated pawl pin 36 lies against the stop 42 and the cylindrical body 46 with its diametrical channel 48 is aligned with the selecting channel 38 to open the same.

The operation of the selected storage unit occurs in the same manner as in the previously discussed embodiment of FIGS. 1 and 2 in that the platen, and, therefore, the associated pawl discs 24 are rotated by a given number of line spacings in the direction R and the pawl 26 on the pawl disc 24 of the selected storage unit engages the toothed disc 30. The platen is then driven in the direction V so that the separating roller 14 of the selected storage unit is driven in the direction V and feeds the uppermost sheet of the stack in the storage unit to the platen. In the cases of the nonselected storage units, the pawls 26 thereof do not engage the toothed discs 30 because the pawl pins 36 have either not as yet entered the selecting channel 38 or have passed through the same and have been prevented by the spring 40 from entering into the selecting channel 38.

When the sheet from the selected storage unit has been engaged upon the platen it is drawn thereby a sufficient number of line spacings in the forward direction V. Subsequently, the platen is again rotated rearwardly in the direction R to the sheet-feeding direction in order to position the sheet at the first line to be imprinted.

During the rotation in the direction R, the pawl pins 36 of all the storage units are located in back of the leaf-type spring 40 and at the stop 43 so that in none of the storage units is an engagement of the pawls 26 with the toothed disc 30 possible during the imprinting process of the sheet, in the course of which the platen is rotated in the direction V.

Preferably, the sheet is first drawn as far into the platen in the direction V so that its trailing edge is completely pulled out of the separating roller 14. A deflecting element can be provided between the separating roller 14 and the platen which guides the trailing rear edge of the sheet past the separating roller 14 when the sheet is subsequently pushed back in the direction V in order to position the sheet in the first line position of imprinting.

during the printing process, the platen can be rotated in the forward direction V and in the backward direction R in any desired manner without an unintentional selecting and feeding cycle occurring. This is due to the fact that, when the sheet is drawn onto the platen during the rotation of the platen in the direction V, the selecting discs 32 of all the storage units are rotated in the direction V by the pawl discs 24 and the pawl discs 26 have their pawl pins 36 adjacent the stop 42.

The counting wheel 50 is moved past the switching cam 54 and rotated by the same. Consequently, the diametrical channel 48 of the cylindrical body 46 is rotated with respect to the selecting channel 38 so that entry to the selecting channel 38 is blocked. During the forward and rearward rotations of the platen, the counting wheel 50 is rotated forwardly and backwardly in a corresponding manner without the inlet to the selecting channel being able to receive the pawl pins 36.

Only when the sheet has been completely imprinted and ejected from the platen, and the counting wheel 50 has executed a complete revolution so that it is once again in the position in which the diametrical channel 48 is aligned with the selecting channel 38 can the pawl pins enter the selecting channel. In the case of the illustrated embodiment, this is after five complete revolutions of the pawl disc 24 in the forward direction V.

Therefore, during the printing process, the platen can be rotated rearwardly and forwardly without a selecting process being initiated by such rotation. It is only when the sheet has been completely imprinted and ejected by the platen that the sheet-feeding device is once again in the basic position in which the next selecting and feeding cycle can be started.

AN ADDITIONAL ALTERNATIVE EMBODIMENT OF THE INVENTION

Figure 9:
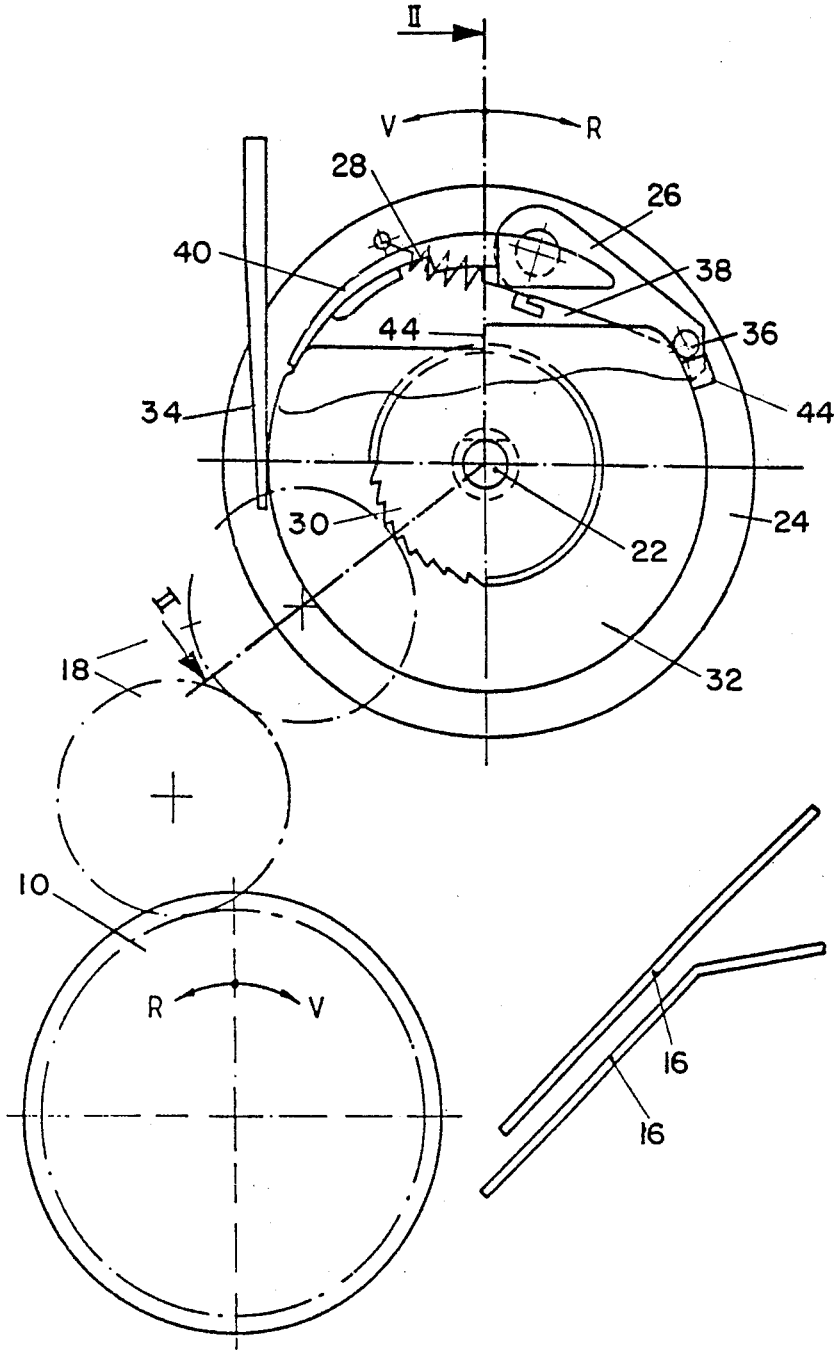
FIG. 9 is a side elevational view of an additional embodiment of the invention.

An additional alternative embodiment of the invention is shown in FIG. 9 of the drawings which corresponds to the previously discussed embodiment of FIGS. 1 and 2. The primary difference lies in the fact that the pawl disc 24 is driven by the gear 10 of the platen through an even number of intermediary gears 18. Consequently, the awl disc 24 and the separating roller 14 are driven in a direction opposite to that of the platen.

For instance, if the platen is rotated in the rearward direction R opposite to the sheet-feeding direction, the separating roller 14 is driven in the sheet-feeding direction in which the separating roller 14 draws the uppermost sheet of the stack out of the associated storage unit and feeds it to the platen. However, during the rotation of the platen in the direction V, which is the sheet-feeding direction, the separating roller 14 is driven in the opposite direction to the sheet-feeding direction with the result that the pawl 26 cannot engage the toothed disc 30 and the separating roller 14 is not activated. In the device of FIG. 9, which modifies the embodiment of FIGS. 1 and 2, the platen 10, starting from the basic position shown in FIG. 9, is rotated a given number of line spacings in the sheet-feeding direction V. The pawl disc 24 is rotated thereby in the direction V with the pawl pin 36, which initially lies against the stop 42 of the selecting disc 32, moving along the periphery of the selecting disc 32, which is restrained against movement by the braking element 34 and whereby the pawl pin 36 enters the selecting channel 38. After a given number of increments of rotational movement of the platen, the pawl pin 36 engages the entrainment abutment 44 of the selecting channel 38 and the pawl pin 36 engages the toothed disc 30.

The platen 10, program-controlled, is now rotated in the sheet-feeding direction V and begins to draw a sheet from the accurately defined starting position of its forward edge. The pawl disc 24 is thereby again rotated in the forward direction V. The pawl pin 36 advances further through the selecting channel 38 and emerges from the selecting channel 38 by deflecting the leaf spring 40.

During the drawing in of the sheet by the platen in the direction V as the sheet is imprinted, the pawl pin 36 rotates in the direction V along the perimeter of the selecting disc 32, which is again restrained by the braking element 34 until it engages the stop 42 of the selecting disc 32.

In the case of the inactivated storage units, the selecting channel 38 is angularly displaced from the stop 42 and, during the initial rotation of the pawl disc 24 in the direction V by a number of linen spacings assigned to the storage unit to be selected, the pawl pins 36 of the non-selected storage units have either not yet reached the selecting channel 38 or been moved completely through the selecting channel 38 by deflection of the leaf spring 40.

When subsequent rotation of the pawl disc 24 in the direction R feeds the sheet to the platen from the selected storage unit, the pawl pins 36 of the nonactivated storage units again engage the stop 42 since they have either not reached the selecting channel 38 or been prevented by the leaf spring 40 from entering the selecting channel 38. Consequently, the pawls 26 in the non-selected storage unit do not engage the toothed disc 30 so that no activation of the separating means or rollers 14 occurs.

When the selected sheet is drawn in by the platen, the pawl discs 24 of all the storage units rotate in the direction V so that the pawl pins 36 of the storage units which have not been selected pass through the selecting channel 38 and arrive at the stop 42. When imprinting of the sheet occurs, the platen can be rotated forwardly or backwardly and, as long as the pawl pins 36 have not as yet reached the inlet side of the selecting channel 38, the platen can be rotated forwardly and backwardly to any extent without causing the unintentional engagement of the pawls of the storage units and the withdrawal of a sheet from the selected storage unit while another sheet is still engaged by the platen.

when the sheet is completely imprinted and has been ejected from the platen 10, the pawl pins 36 of all the storage units are located at the stop 42. The platen, in a programmed manner, is now rotated in the opposite direction to the sheet-feeding direction by one line spacing, which corresponds to one rotary step of pawl disc 24. Consequently, the pawl pins 36 of all the storage units moving in the direction R again contact the stop 42 so that the entire sheet-feeding device is once again situated in the basic position for the next selection cycle shown in FIG. 1.

I claim:

1. A device for feeding individual sheets to the platen of a printing apparatus which incorporates a plurality of storage units each accommodating a stack of individual sheets, said device also incorporating separating means assigned to each storage unit engageable with the uppermost sheet of a respective stack in a respective storage unit, said device being driven by said platen and further incorporating selecting means for each storage unit driven by said platen to permit only the driving of the separating means of a selected storage unit, whereby each selecting means incorporates a driven engagement member and a switching means located at a given rotary distance from one position, which rotary distance differs for each storage unit and whereby said switching means guides said engagement member in one direction of rotation into an engagement position for establishing the driving connection for said separating means and in the opposite direction of rotation guides said engagement member beyond said engagement position, characterized by the provision of locking means for each selecting means which in one direction of rotation lock and release said switching means and furthermore characterized by a counting device which, by addition or subtraction, counts or measures the line movement of said printing apparatus platen in forward or reverse directions and, after the number of line movements corresponds to the complete sheet-feeding and printing cycle, switches the locking device from the blocking position to the releasing position.

2. The device of claim 1 in which said counting device includes a star-shaped counting wheel which is located at the pawl disc or selecting disc and whereby said counting wheel is switched in a step-by-step manner by a stationary switching cam.

3. The device of claim 1 wherein the locking device incorporates a rotary body having a channel, said body being rotatable by means of said counting device.

4. The device of claim 3 in which said locking device body and said counting wheel are integral and said body provides the pivotal bearing for said counting wheel.

5. The device of claim 4 in which said locking device and the counting device incorporate a stop establishing their original position.

* * * * *